US010711973B1

(12) United States Patent
Antriasian

(10) Patent No.: US 10,711,973 B1
(45) Date of Patent: Jul. 14, 2020

(54) ADJUSTABLE AND DIRECTIONAL LIGHT ENHANCING ATTACHMENT FOR METAL LAMP REFLECTORS

(71) Applicant: Paul Merwin Antriasian, Palmdale, CA (US)

(72) Inventor: Paul Merwin Antriasian, Palmdale, CA (US)

( * ) Notice: Subject to any disclaimer, the term of this patent is extended or adjusted under 35 U.S.C. 154(b) by 72 days.

(21) Appl. No.: 16/130,754

(22) Filed: Sep. 13, 2018

Related U.S. Application Data

(63) Continuation-in-part of application No. 15/130,833, filed on Apr. 15, 2016, now Pat. No. 10,101,007.

(60) Provisional application No. 62/148,888, filed on Apr. 17, 2015.

(51) Int. Cl.
*F21V 7/00* (2006.01)
*F21V 7/09* (2006.01)
*F21V 7/16* (2006.01)

(52) U.S. Cl.
CPC ..... *F21V 7/0025* (2013.01); *F21V 7/09* (2013.01); *F21V 7/16* (2013.01)

(58) Field of Classification Search
USPC ..... 362/283
See application file for complete search history.

(56) References Cited

U.S. PATENT DOCUMENTS 6,883,952 B2 * 4/2005 Sander ..... G02B 21/06 362/231

* cited by examiner

*Primary Examiner* — Rafferty D Kelly
(74) *Attorney, Agent, or Firm* — Plager Schack LLP; Mark H. Plager; Alexis J. Saenz

(57) ABSTRACT

A light enhancing system is disclosed which extends the available area for capturing light from a source and adjustably increases the light concentration on a subject being lit. Embodiments may be beneficial to applications including grow lighting. One or more reflector panels may be detachably coupled to a lighting unit by a quick-connect fastener on the end of a flexible arm. Examples of quick-connect fasteners include threaded ends, press-fit ends, and magnetic ends. In some embodiments, the reflector panel may be retrofit onto a conventional lighting unit.

9 Claims, 14 Drawing Sheets

ADJUSTABLE AND DIRECTIONAL LIGHT ENHANCING ATTACHMENT FOR METAL LAMP REFLECTORS

CROSS-REFERENCE TO RELATED APPLICATIONS

This application claims benefit under 35 U.S.C. § 119(e) of U.S. Provisional Applications having Ser. No. 62/148,888 filed Apr. 17, 2015, and U.S. Non-Provisional application Ser. No. 15/130,833 filed Apr. 15, 2016, which are hereby incorporated by reference herein in their entirety.

BACKGROUND

The embodiments herein relate generally to lighting systems, and more particularly, to an adjustable and directional light enhancing attachment for metal lamp reflectors.

Conventional lighting systems provide inefficient light concentration onto subject areas. For example, fluorescent and incandescent systems typically provide a diffuse light output. While for most daily room lighting systems, light diffusion may be sufficient for a person's visibility, other application may need more light concentration. For example, indoor growing systems use artificial lighting to help stimulate photosynthesis. Under the proper wavelengths, plant growth can be substantial. However, with conventional lighting, light is emitted omnidirectional and thus, a significant portion of light energy is emitted away from a subject area. Some lighting systems, for example, an elongated fluorescent tube bulb and rectangular housing, include reflective internal surfaces of the housing to bounce more light back toward the subject area. Yet these systems still lose a lot of light to the periphery of the housing. The angles of the internal reflective surfaces are static and some surfaces do not point reflected energy to the subject area.

As can be seen, there is a need for a lighting system that improves the reflection of light toward a subject area.

SUMMARY

According to one embodiment, a light enhancing system comprises a light housing including: a light source, a first reflector panel extending from the light housing, and a mount. The system further comprises a second reflector panel; a first flexible arm including a distal first end affixed to the second reflector panel, wherein the first flexible arm projects outwardly from an exterior of the light housing and the second reflector panel on the distal end of the flexible arm is also exterior of the light housing; a third reflector panel and a second flexible arm affixed to the third reflector panel; and a swivel joint mount coupling the first flexible arm and the second flexible arm to the light housing, wherein the swivel joint mount is configured to rotate freely about an axis transverse to the first or second flexible arm in response to airflow impacting the second reflector panel or the third reflector panel.

According to another embodiment, a light enhancing system comprises a light housing including: a light source, a first reflector panel extending from the light housing, and a mount. The system further comprises a second reflector panel; a first flexible arm including a distal first end affixed to the second reflector panel, wherein the first flexible arm projects outwardly from an exterior of the light housing and the second reflector panel on the distal end of the flexible arm is also exterior of the light housing; a first quick-connect fastener on a proximal second end of the first flexible arm, the first quick-connect fastener attachable and detachable to the mount of the light housing, wherein, when the first quick-connect fastener is attached to the mount, a distal edge of the second reflector panel is positioned beyond and disconnected from a distal end of the first reflector panel, and wherein the first flexible arm is configured to adjust an angle of reflection of light from the light source off an underside of the second reflector panel; a third reflector panel, a second flexible arm affixed to the third reflector panel, and a second quick-connect fastener coupled to the second flexible arm, wherein the third panel reflector is removably attached to the light housing by coupling the second quick-connect fastener to the mount; and a swivel joint mount coupling the first flexible arm and the second flexible arm to the light housing, wherein the swivel joint mount is configured to rotate freely about an axis transverse to the first or second flexible arm in response to airflow impacting the second reflector panel or the third reflector panel.

BRIEF DESCRIPTION OF THE FIGURES

The detailed description of some embodiments of the present invention is made below with reference to the accompanying figures, wherein like numerals represent corresponding parts of the figures.

DETAILED DESCRIPTION OF CERTAIN EMBODIMENTS

The word "exemplary" is used herein to mean "serving as an example or illustration." Any aspect or design described herein as "exemplary" is not necessarily to be construed as preferred or advantageous over other aspects or designs.

Generally, embodiments of the subject technology provide light enhancement for applications such as grow lighting. Exemplary embodiments improve the amount of light reflected onto a subject area. Aspects of the lighting system make better use of a light source by shortening the distance to the targeted area of, for example, a garden subjected to grow lighting. In addition, energy is saved and produces more light by capturing what would otherwise be stray lost light with no additional heat. In some embodiments, a detachable attachment system may retrofit onto grow light sources in the garden and greenhouse industry. As will be appreciated, features of the embodiments disclosed will increase the yield in any garden using grow light.

Figure 1:
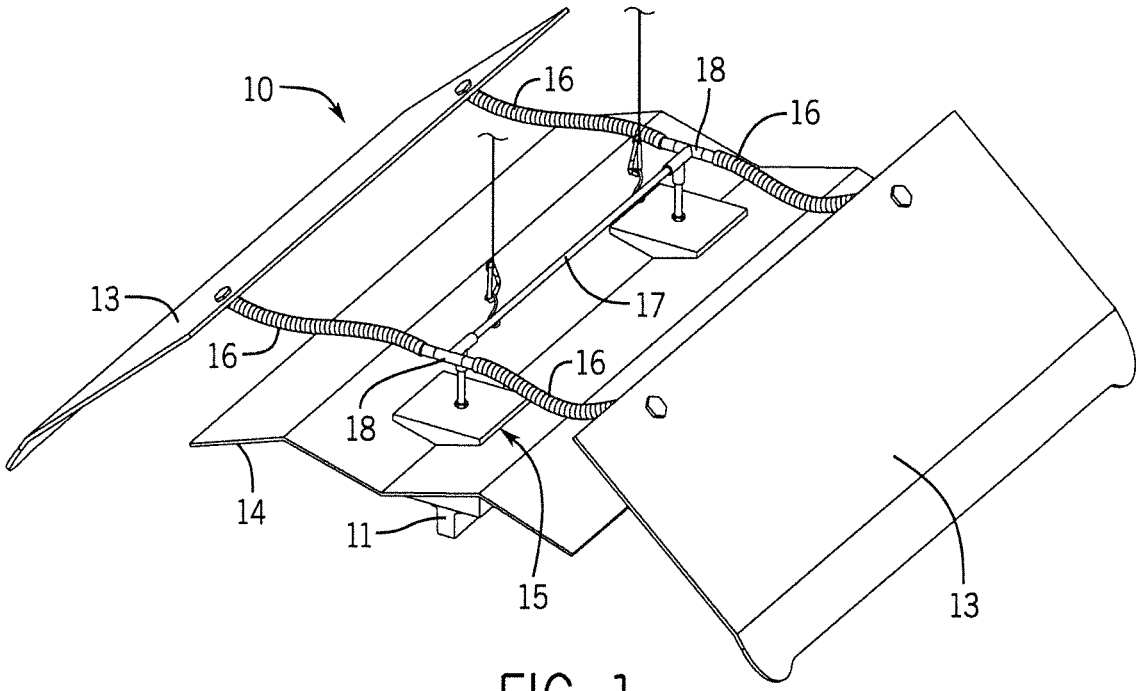
FIG. 1 is a perspective top view of a light enhancing system in accordance with an exemplary embodiment of the subject technology.
Figure 2:
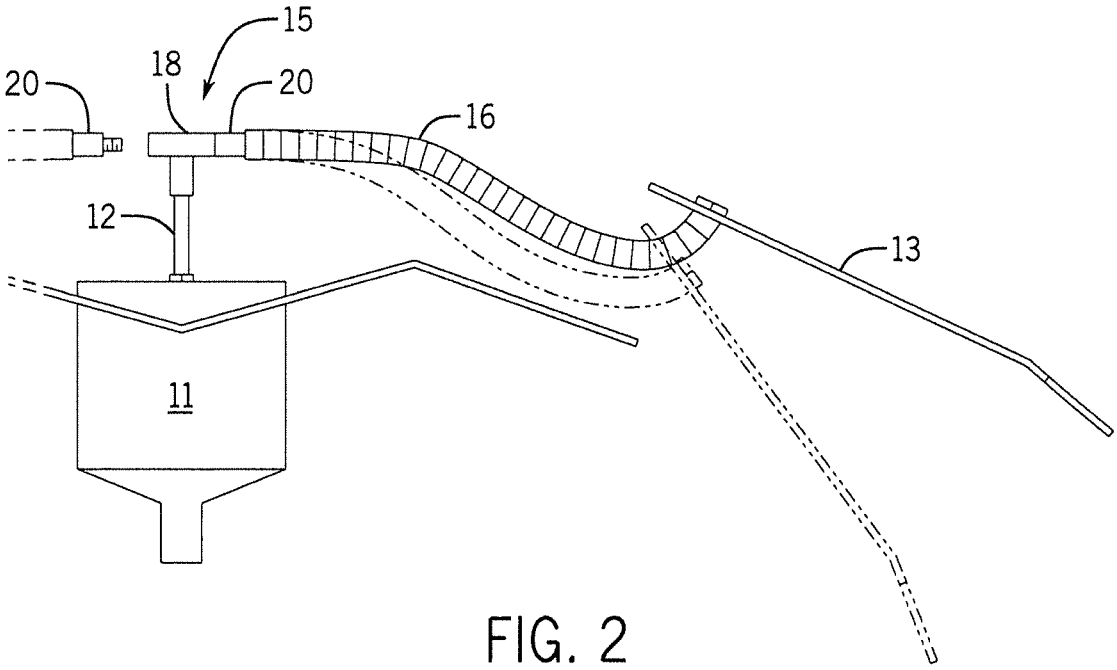
FIG. 2 is an end view of the system of FIG. 1 illustrating adjustable movement of a panel reflector.
Figure 3:
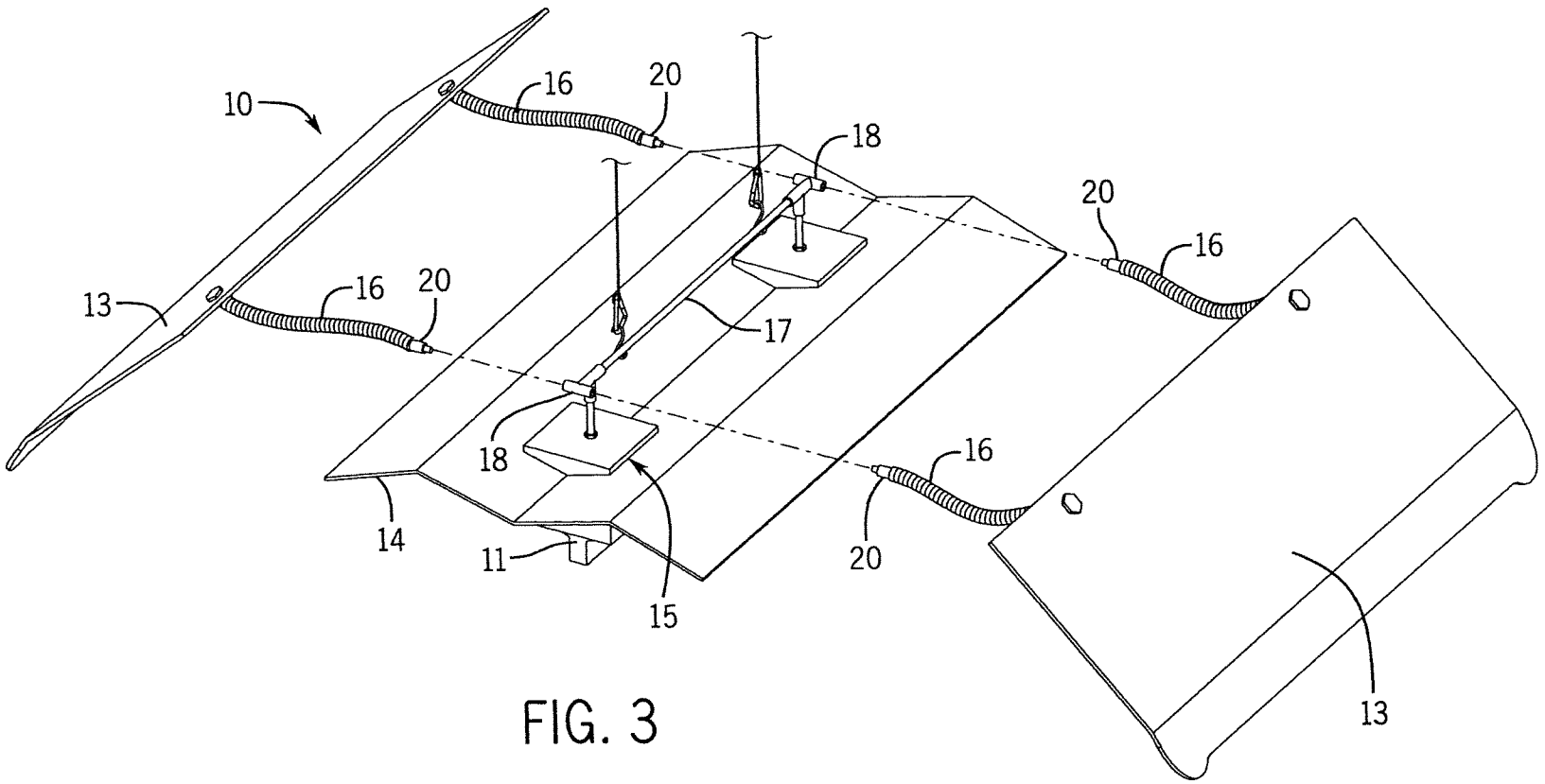
FIG. 3 is an exploded view of the system of FIG. 1.

Referring now to FIGS. 1-3 a light enhancing system 10 (sometimes referred to generally as the "system 10") is shown according to an exemplary embodiment of the subject technology. The system 10 includes a lighting unit 11 with one or more reflector panels 14 disposed to reflect light emitting upward from the lighting unit 11 back down and in the direction of an area being subjected to light. In some embodiments, the reflector panel(s) 14 may extend laterally from a light source and may include a central apex with sections of the reflector(s) 14 projecting toward gravity in an obtuse angle from the apex. In other embodiments, (as previously mentioned), the lighting unit 11 may be for example, a conventional fluorescent lighting box-type fixture.

The system 10 may include a mount fixture 15. In some embodiments the mount fixture 15 is permanently affixed to the lighting unit 11. In some embodiments the mount fixture 15 is retrofit on to the lighting unit 11 housing. The mount fixture 15 may include one or more post(s) 12 extending up from the housing. In some embodiments the mount fixture 15 may include two mounting points and a cross bar 17 connecting the two points across a length of the housing. A 4-way tee coupler 18 may connect the cross bar 17 to the posts 12.

In an exemplary embodiment, the system 10 includes a lamp reflector panel 13, a flexible arm 16 including a first end affixed to the metal lamp reflector panel 13 and a quick-connect fastener 20 on a second end of the flexible arm 16. Some embodiments may include a single reflector panel 13 and one or more flexible arms 16 extending therefrom while other embodiments may include two or even more reflector panels 13 attached to the lighting unit 11. In general, the lamp reflector panel 13 is disposed to extend the area of available light reflection from the lighting unit 11. For example a distal edge of the reflector panel 13 may be positioned beyond a distal end of the reflector panel 14. In some embodiments, the reflector panel 13 may include a flap on the distal edge to further catch and reflect stray lighting from the lighting unit 11. The reflector panel 13 and reflector panel 14 may be metallic, which may include a hammered finish on the underside surface (not shown). The quick-connect fastener 20 may be a threaded or press-fit connector which may be attachable to the tee-coupler 18. The flexible arm 16 may include for example gooseneck tubing. When connected to the mount fixture 15, a user may adjust positioning of the lamp reflector panel 13 by bending the flexible arm 16 so that an angle of reflection of light from the lighting unit 11 off the underside of the lamp reflector panel 13 is adjusted to catch more or less light and reflect more or less light onto an area as desired. As shown in FIG. 2, the flexible arm 16 may be moved to position the underside surface of the reflector panel 13 generally higher and lower and with radial variation from the lighting unit 11.

Figure 4:
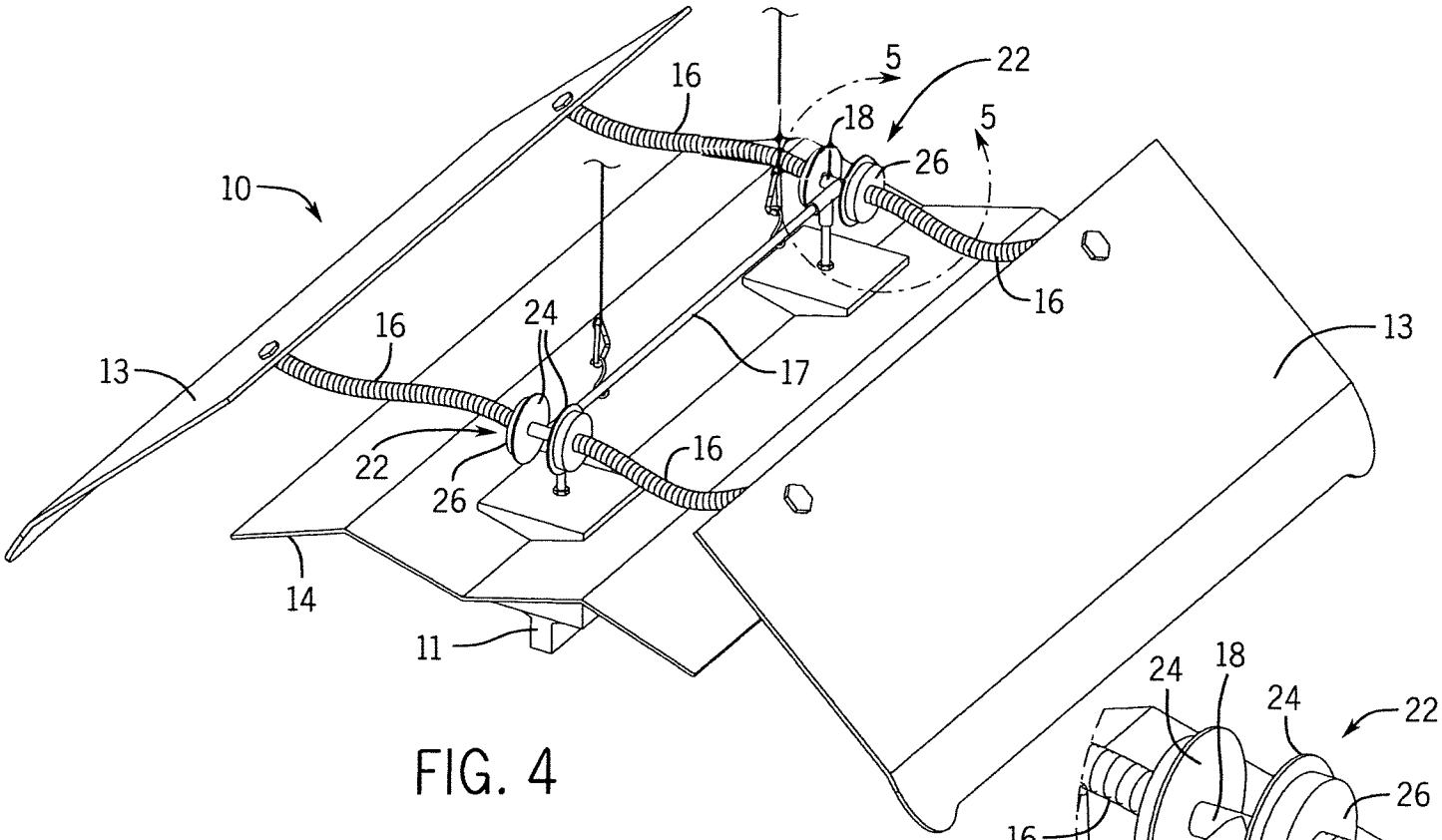
FIG. 4 is a perspective top view of a light enhancing system in accordance with another exemplary embodiment of the subject technology.
Figure 5:
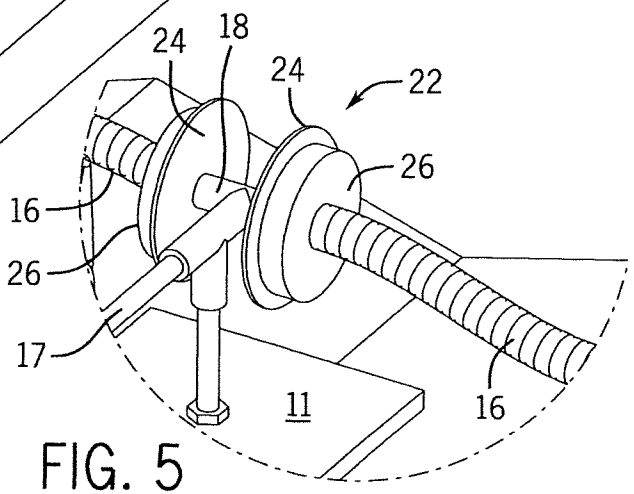
FIG. 5 is an enlarged view of the circle 5 of FIG. 4.
Figure 6:
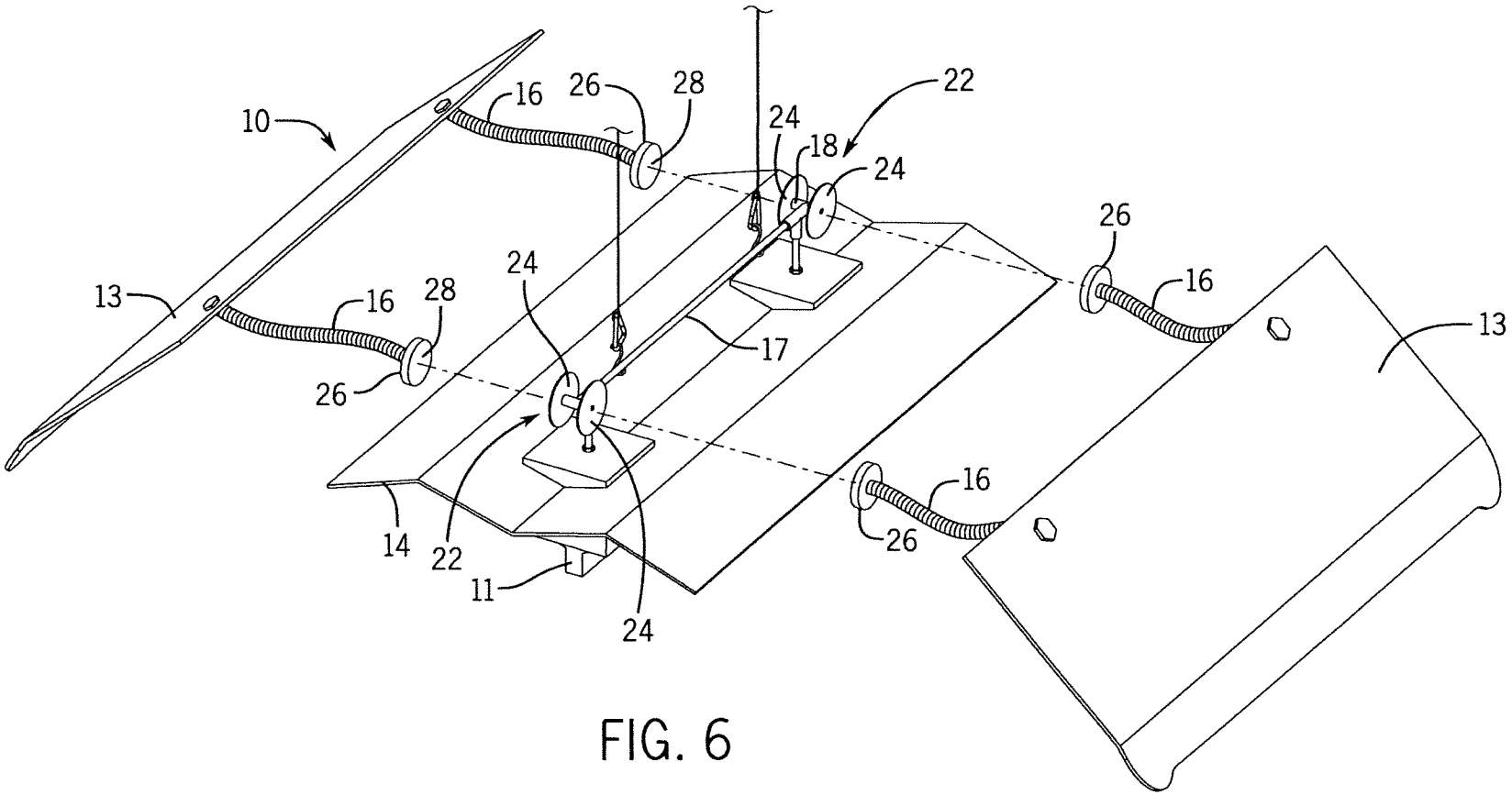
FIG. 6 is an exploded view of the system of FIG. 4.

Referring now to FIGS. 4-6, the system 10 is shown according to an alternate embodiment. The embodiment shown in FIGS. 4-6 is similar to the embodiment shown in FIGS. 1-3 except that the quick-connect fastener 20 includes a magnet 26 and a mount fixture 22 on the lighting unit 11 includes one or more washers 24 configured to receive the magnets 26. In the embodiment shown, each mounting point may include two washers 24 affixed to the tee couplers 18 so that there is one washer 24 for every magnet 26 attaching the reflector panels 13 to the lighting unit 11. As will be appreciated, embodiments using magnets 26 on the ends of flexible arms 16 are readily attachable and detachable not only to the mount fixture 22 as shown but are easily retrofit onto existing off the shelf lighting units with metallic fixture housing.

Figure 7:
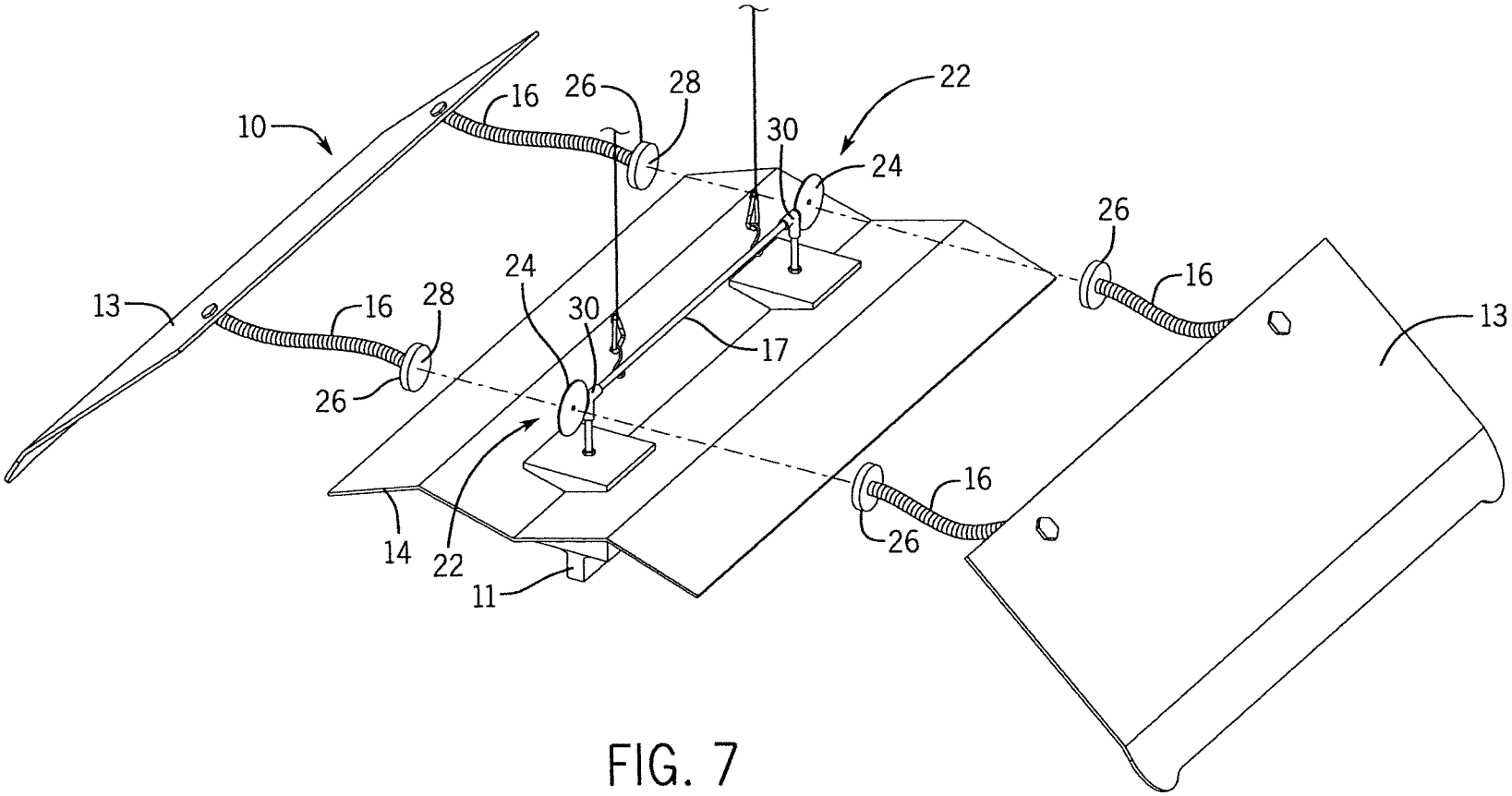
FIG. 7 is a perspective top view of a light enhancing system in accordance with yet another exemplary embodiment of the subject technology.
Figure 8:
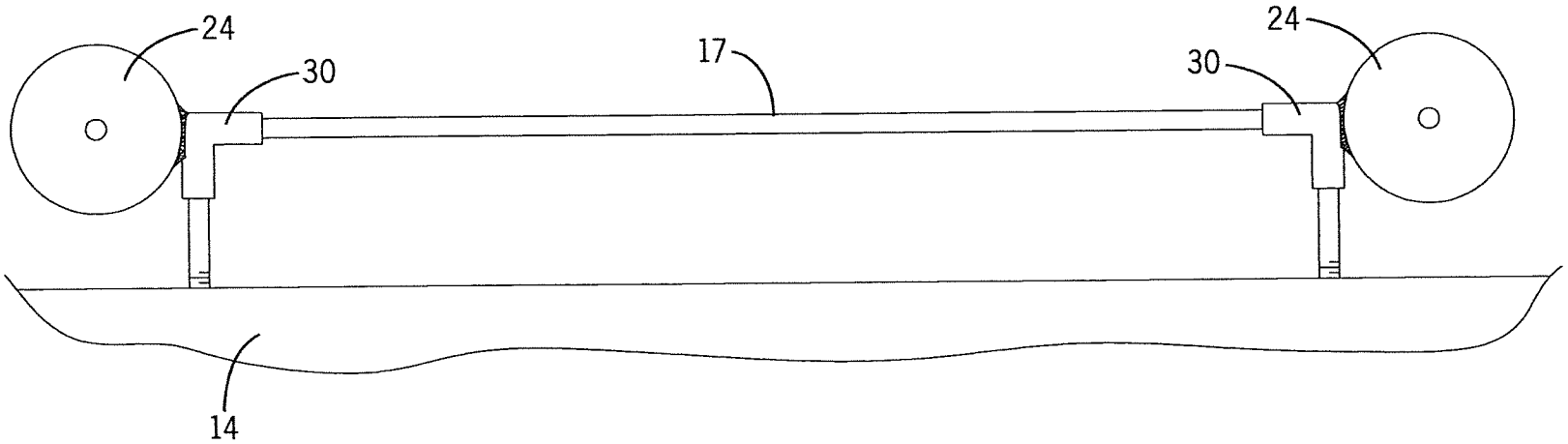
FIG. 8 is a partial side of an alternate mount fixture of FIG. 7 without surrounding elements.
Figure 9:
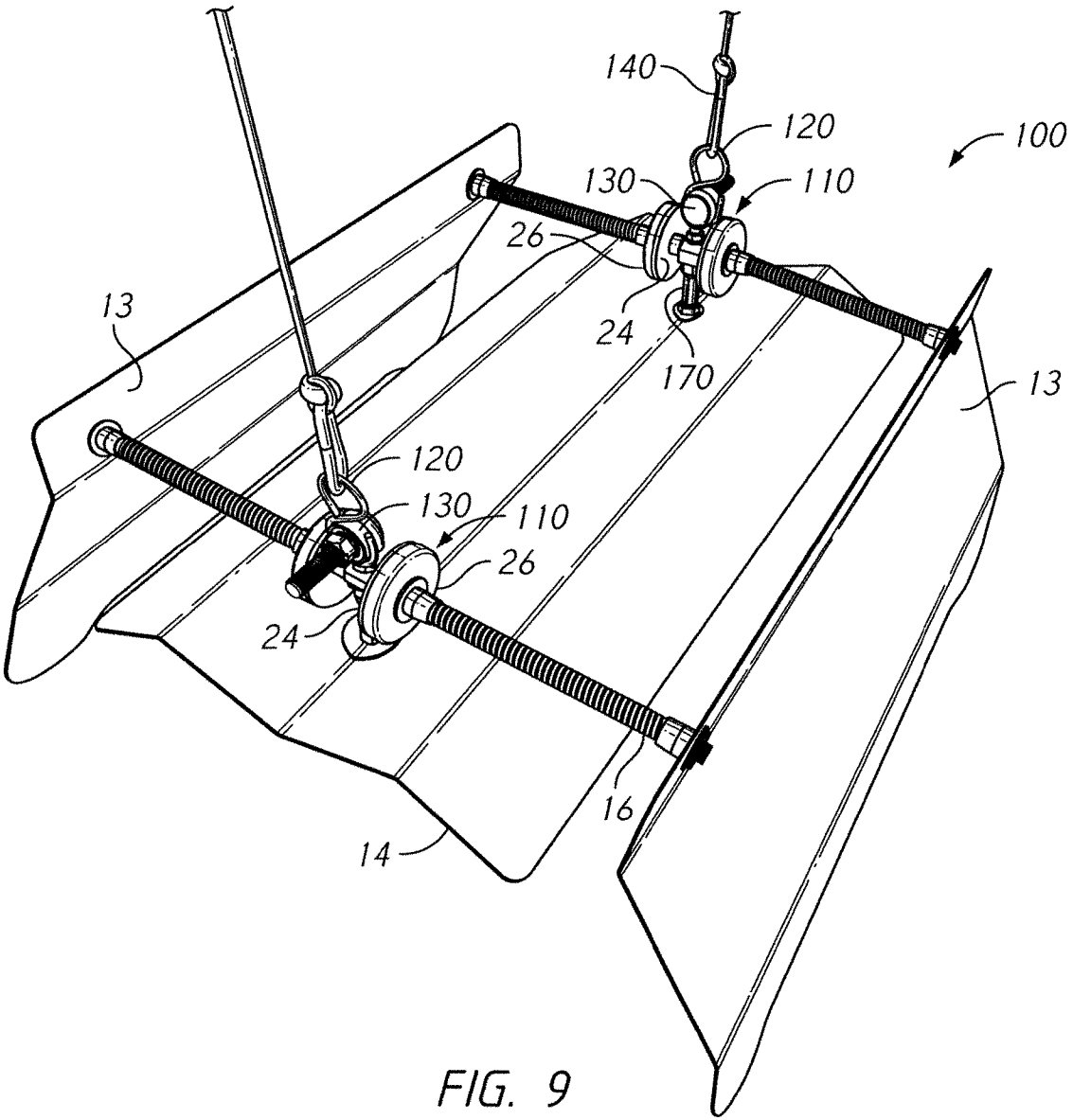
FIG. 9 is a top perspective view of a light enhancing system in accordance with another exemplary embodiment of the subject technology.
Figure 10:
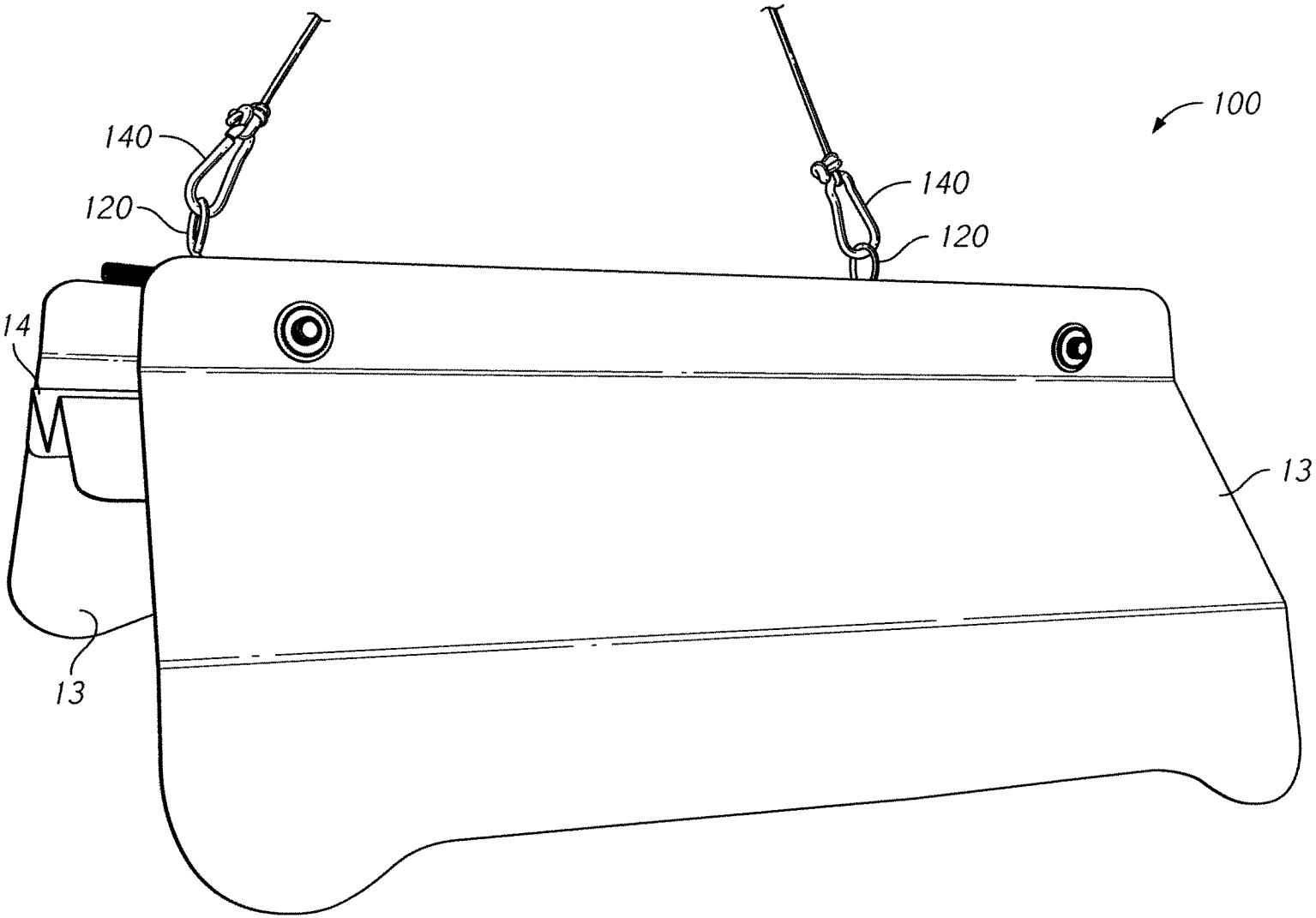
FIG. 10 is a side perspective view of the system of FIG. 9.
Figure 11:
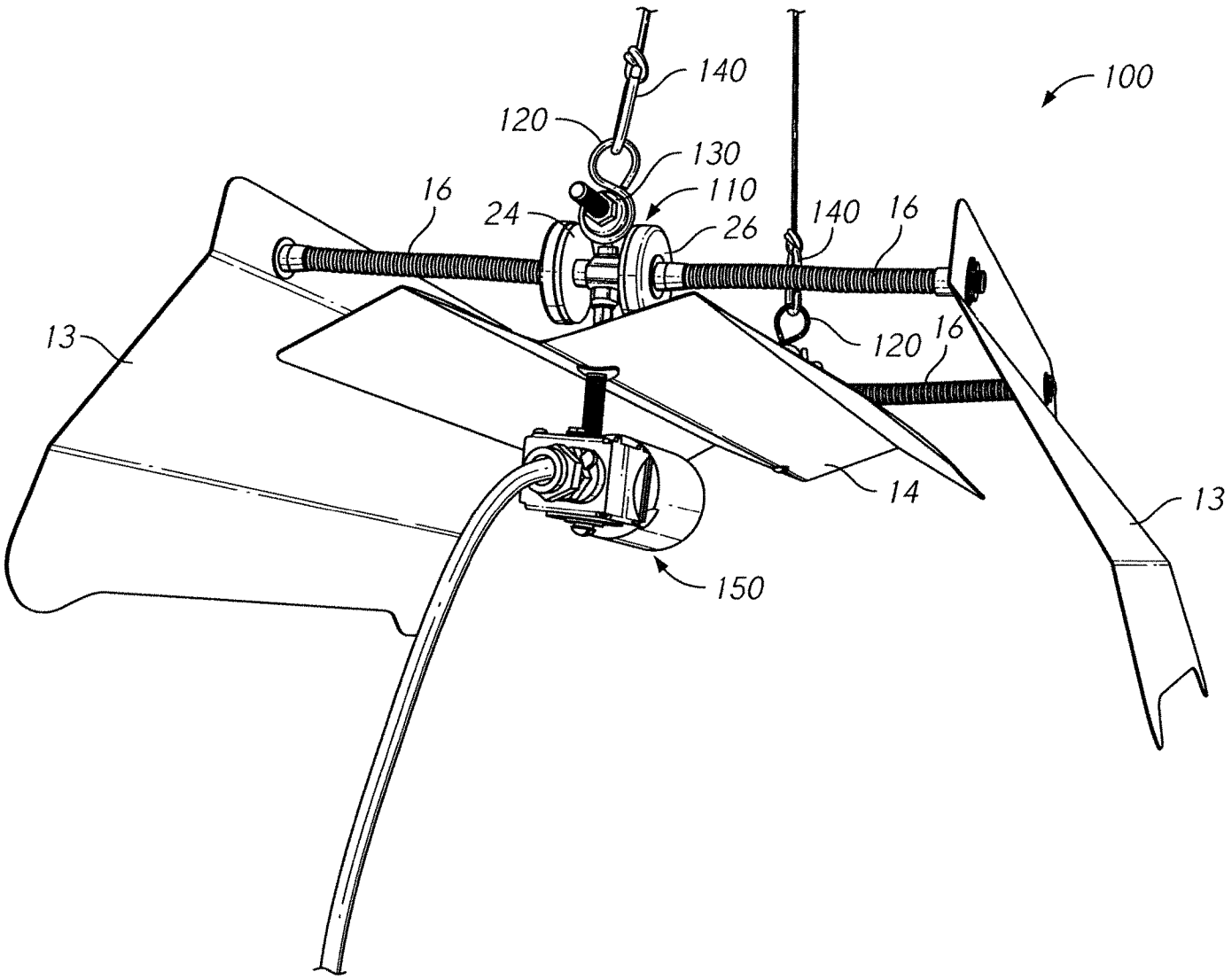
FIG. 11 is a left end perspective view of the system of FIG. 9.
Figure 12:
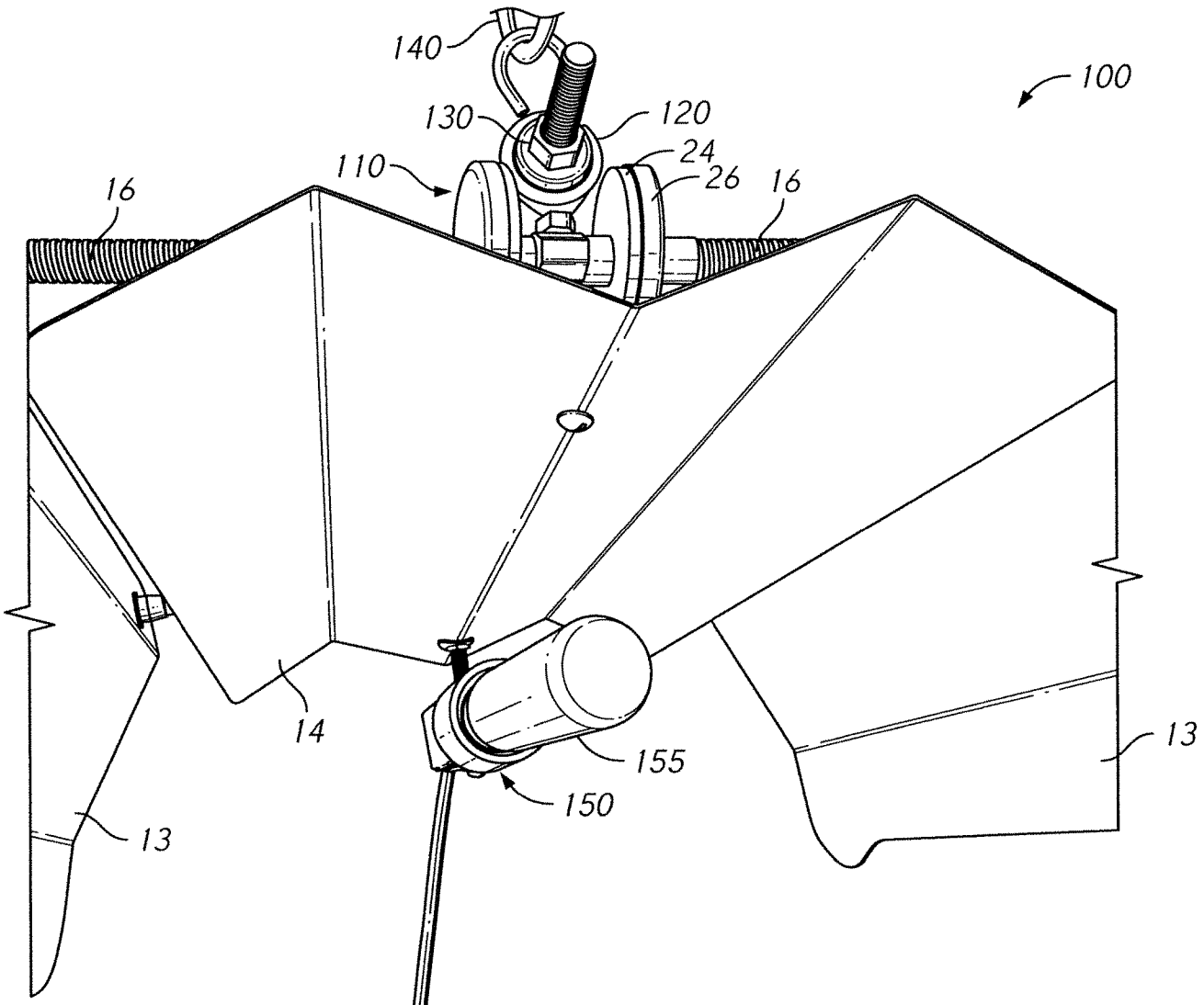
FIG. 12 is a right end perspective view of the system of FIG. 9.
Figure 13:
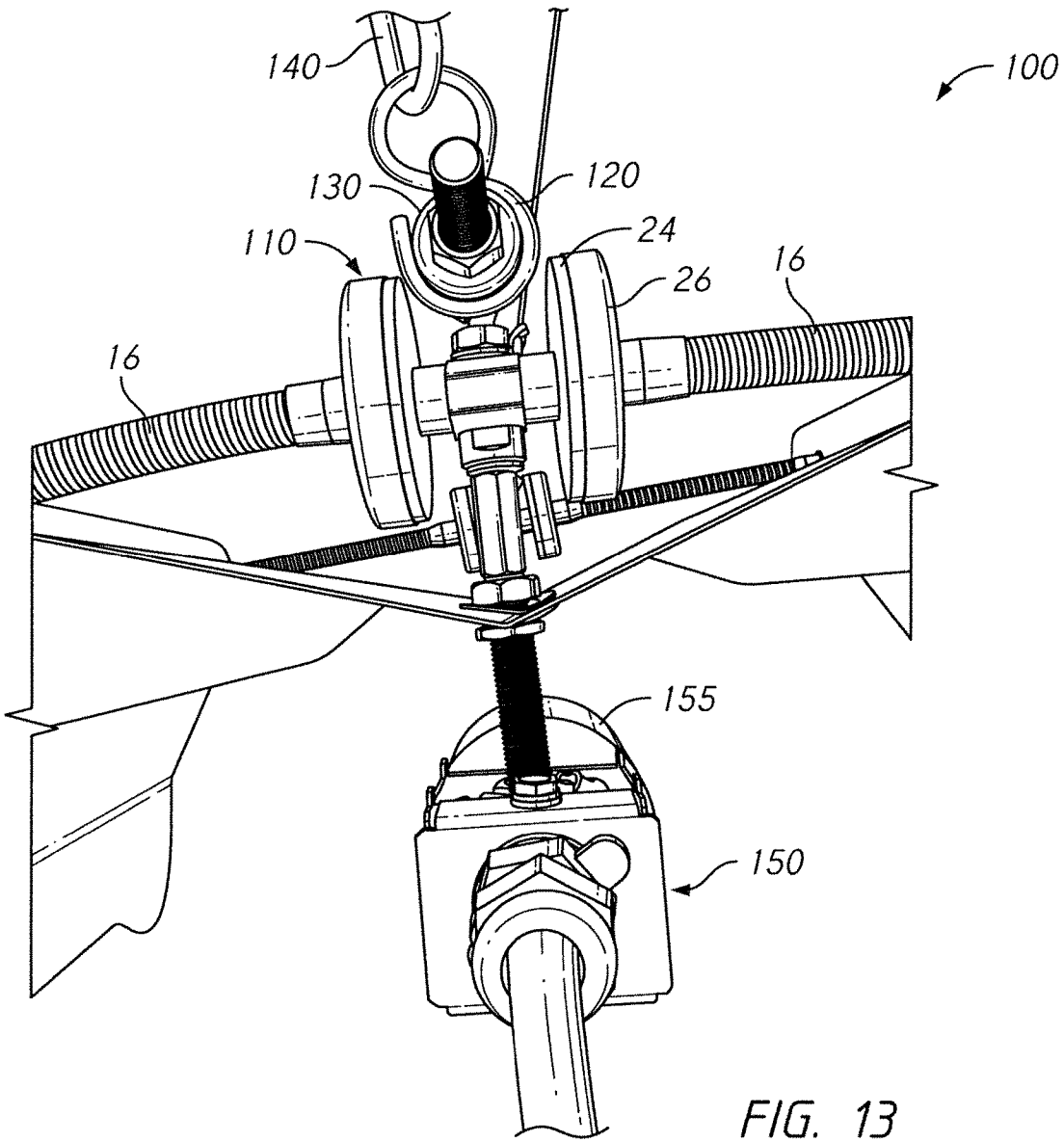
FIG. 13 is an enlarged partial view of a swivel joint from the left end perspective of the system in accordance with an exemplary embodiment.
Figure 14:
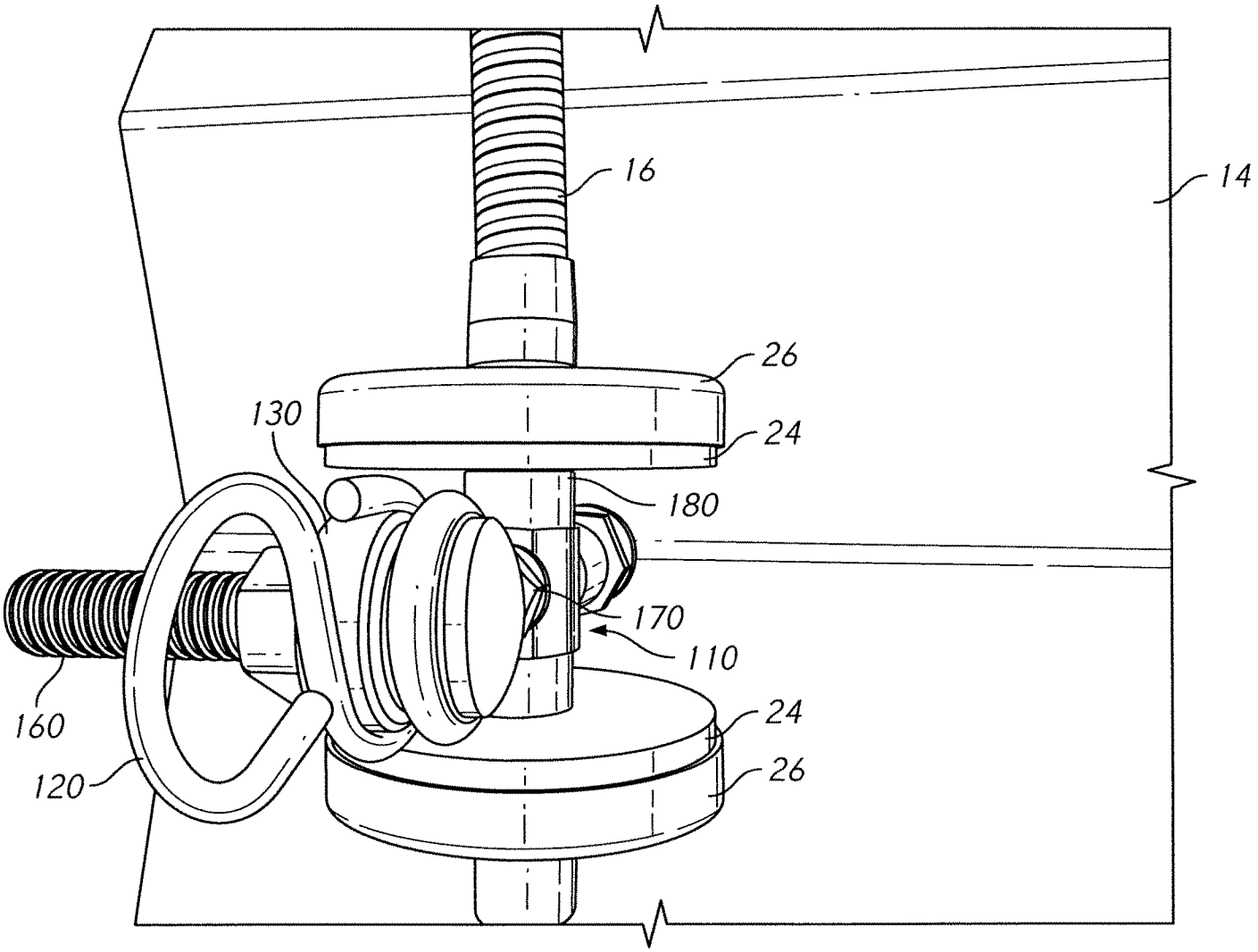
FIG. 14 is a top perspective view of the swivel joint of FIG. 13.

Referring now to FIGS. 7-8, the system 10 is shown according to another alternate embodiment. In FIGS. 7-8, the system 10 is similar to the system 10 shown in FIGS. 4-6 except that the mount fixture includes a single washer 24 tact welded by its edge to an elbow joint 30 on each end of the cross-bar 17. In embodiments with reflector panels 13 on opposing sides of the lighting unit 11, a magnet 26 from opposing flexible arms 16 may each attach onto an opposing side of a common washer 24.

Referring now to FIGS. 9-14, a light enhancing system 100 (sometimes referred to generally as the "system 100") is shown according to an exemplary embodiment of the subject technology. The system 100 is similar to the system 10 except that the system 100 includes a swivel joint mount 110 instead of the mount fixture 15. For example, the system 100 may include the same reflector panels 13 and reflector panel 14 and flexible arms 16. As will be appreciated, the system 100 may be configured to freely sway back and forth from the swivel joint mount 110. As known by those of ordinary skill in the art, a grow room may often include a circulation system (not shown) which moves air around the room. Aspects of the swivel joint mount 110 enable the system 100 to be rocked, swayed, or generally moved in rotation about an axis that is transverse to the flexible arms 16. The rotation may be for example, between 0 degrees to ±30 degrees (and may be generally narrower depending on the air current providing the impetus). As a result, by leveraging the force provided by air circulation, when the system 100 rotates, the light shining from a light source 155 (FIG. 12) and reflected by the reflector panels 13 and 14 is distributed among a wider area of coverage below the system 100. The number of systems 100 needed to irradiate an area may be decreased. In addition, the intensity of the light shining on an area below the system 100 may be diffused providing a more even irradiation, which may be more effective at reducing damage to items such as plants.

FIGS. 9-14 show the system 100 including the swivel joint mount 110 including a washer 24 and magnet 26 on the end of respective opposing flexible arms 16 similar to the embodiments in FIGS. 4-8 above. For sake of brevity, the following will describe a single swivel joint mount 110, however it will be understood that embodiments may generally include two swivel joint mounts 110 with one supporting each end of the system 100 as shown in the drawings. The swivel joint mount 110 may generally include a free rotating device coupled to the reflector panels 13 and 14.

In an exemplary embodiment, the free rotating device may be for example a bearing 130 coupled to a post system 170 that is connected to the reflector panel 14 (or the housing in general for the system 100's light source). The post system 170 may be perpendicular to a cross-post 180 that may be generally aligned with, and extending in connection between, the centers of the washers 24. A light socket 150 and light source 155 (see FIGS. 11-13) may be positioned generally centered between the two swivel joint mounts 110 but on an opposite side (underside) of the reflector panel 14. The bearing 130 may be for example, a disc-type bearing with a central opening. A nut and bolt (or other fastener) may secure the bearing 130 to the post system 170 (shown in detail in FIGS. 12-14). In one embodiment, the bearing 130 may be coupled to a fastener 120 that may be attached to an overhanging support line. For example, the fastener 120 may be an S-shaped hook, the bottom portion of which may be indexed to the curvature of the bearing 130 so that the bearing 130 fits inside and rotates within the inner curvature of the hook. The fastener 120 may be coupled to a clip 140 that is attached to a support wire.

Figure 15:
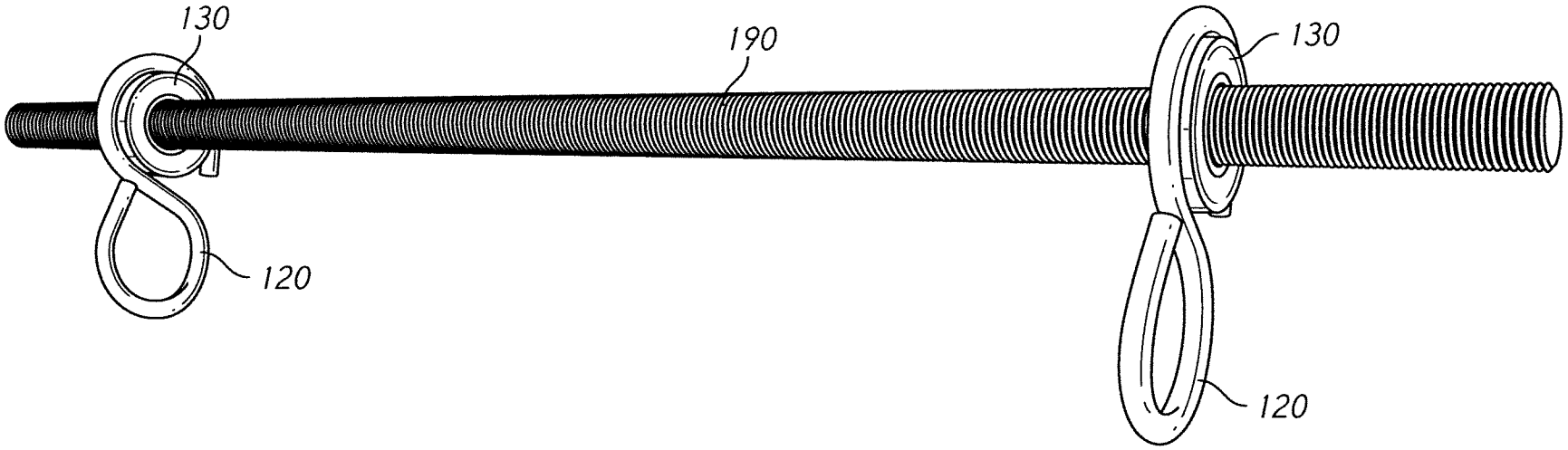
FIG. 15 is a perspective side view of a cross bar with a pair of swivel joints attached in accordance with another exemplary embodiment.
Figure 16:
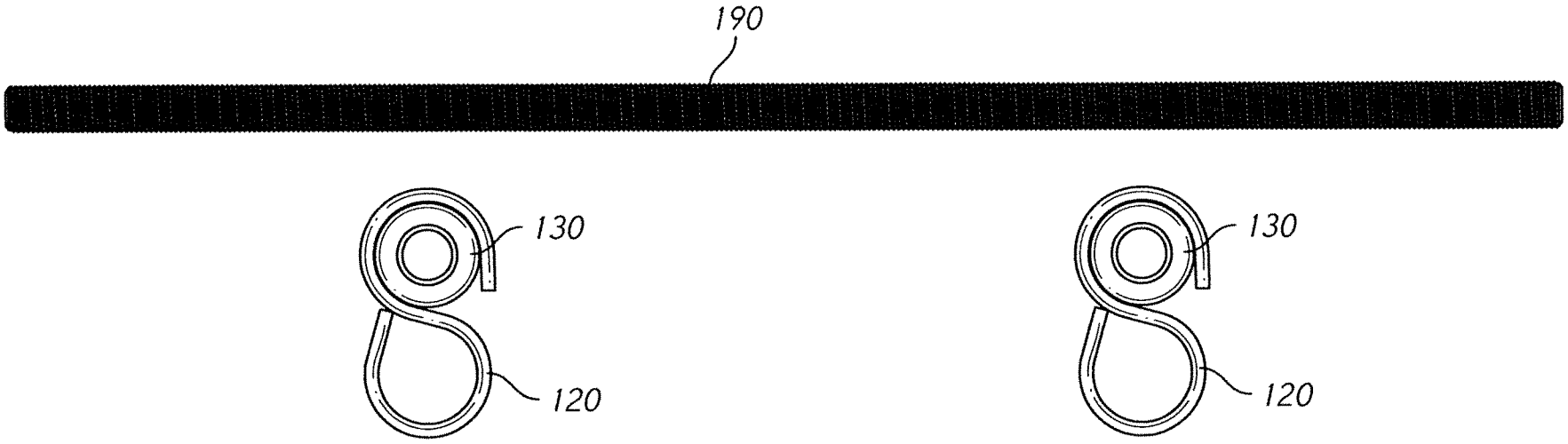
FIG. 16 is a side view of the cross bar and swivel joint elements removed from the cross bar.

FIGS. 15 and 16 shown another embodiment that does not use the magnets 26 to attach the reflector panels 13 to the reflector panel 14. Some embodiments may use a single flexible arm 16 between reflector panels 13 (shown in FIGS. 1-14). In such embodiments, the bearings 130 may have threaded central openings. A pair of the bearings 130 may be screwed or slid into position along a flexible arm 16. It will be understood that the bearings 130 may be positioned into alignment with the post system 170 and attached similarly by nut and bolt as disclosed above. The inner curvature of the bottom half of the S-hook 120 may be similarly coupled to the outer curvature of the bearing 130.

In use, the embodiments in FIGS. 9-16 may operate by the reflector panels 13, catching air circulating through the room. The force on the reflector panels 13 may be transferred to the flexible arms 16, which are transverse to the longitudinal axis of the bearings 130. The bearings 130 will therefor rotate based on the amount of air flow force incident on the reflector panels 13. The bearings 130 will rotate back and forth for example, within the S-hook in a pendulum effect, which will increase arc angle and of light distribution below the system 100.

Persons of ordinary skill in the art may appreciate that numerous design configurations may be possible to enjoy the functional benefits of the inventive systems. Thus, given the wide variety of configurations and arrangements of embodiments of the present invention the scope of the present invention is reflected by the breadth of the claims below rather than narrowed by the embodiments described above.

What is claimed is:

1. A light enhancing system, comprising:
a light housing including:
a light source,
a first reflector panel extending from the light housing, and
a mount;
a second reflector panel;
a first flexible arm including a distal first end affixed to the second reflector panel, wherein the first flexible arm projects outwardly from an exterior of the light housing and the second reflector panel on the distal end of the flexible arm is also exterior of the light housing;
a third reflector panel and a second flexible arm affixed to the third reflector panel; and
a swivel joint mount coupling the first flexible arm and the second flexible arm to the light housing, wherein the swivel joint mount:
is a disc type bearing including a central opening, and
is configured to rotate freely about an axis transverse to the first or second flexible arm in response to airflow impacting the second reflector panel or the third reflector panel.

2. The light enhancing attachment of claim 1, further comprising:
a first quick-connect fastener on a proximal second end of the first flexible arm, the first quick-connect fastener attachable and detachable to the mount of the light housing, wherein, when the first quick-connect fastener is attached to the mount, a distal edge of the second reflector panel is positioned beyond and disconnected from a distal end of the first reflector panel, and wherein the first flexible arm is configured to adjust an angle of reflection of light from the light source off an underside of the second reflector panel; and
a second quick-connect fastener coupled to the second flexible arm, wherein the third panel reflector is removably attached to the light housing by coupling the second quick-connect fastener to the mount.

3. The light enhancing system of claim 2, wherein the first and second quick-connect fasteners are a magnet.

4. The light enhancing system of claim 3, wherein the mount is a washer for receiving the magnet.

5. The light enhancing system of claim 1, further comprising an S-hook coupled to the disc type bearing, wherein the disc type bearing rotates within an inner curvature of a bottom portion of the S-hook.

6. A light enhancing system, comprising:
a light housing including:
a light source,
a first reflector panel extending from the light housing, and
a mount;
a second reflector panel;
a first flexible arm including a distal first end affixed to the second reflector panel, wherein the first flexible arm projects outwardly from an exterior of the light housing and the second reflector panel on the distal end of the flexible arm is also exterior of the light housing;
a first quick-connect fastener on a proximal second end of the first flexible arm, the first quick-connect fastener attachable and detachable to the mount of the light housing, wherein, when the first quick-connect fastener is attached to the mount, a distal edge of the second reflector panel is positioned beyond and disconnected from a distal end of the first reflector panel, and wherein the first flexible arm is configured to adjust an angle of reflection of light from the light source off an underside of the second reflector panel;
a third reflector panel, a second flexible arm affixed to the third reflector panel, and a second quick-connect fastener coupled to the second flexible arm, wherein the third panel reflector is removably attached to the light housing by coupling the second quick-connect fastener to the mount; and
a swivel joint mount coupling the first flexible arm and the second flexible arm to the light housing, wherein the swivel joint mount is configured to rotate freely about an axis transverse to the first or second flexible arm in response to airflow impacting the second reflector panel or the third reflector panel.

7. The light enhancing system of claim 6, wherein the swivel joint mount is a disc type bearing including a central opening.

8. The light enhancing system of claim 7, further comprising an S-hook coupled to the disc type bearing, wherein the disc type bearing rotates within an inner curvature of a bottom portion of the S-hook.

9. The light enhancing system of claim 8, wherein:

the first and second quick-connect fasteners are a magnet;

the mount is a washer for receiving the respective magnets; and the disc type bearing is positioned between respective washers for respective magnets.

* * * * *